US006633647B1

(12) United States Patent
Markow et al.

(10) Patent No.: US 6,633,647 B1
(45) Date of Patent: Oct. 14, 2003

(54) METHOD OF CUSTOM DESIGNING DIRECTIONAL RESPONSES FOR A MICROPHONE OF A PORTABLE COMPUTER

(75) Inventors: Mitchell A. Markow, Spring, TX (US); David E. Gough, Houston, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 823 days.

(21) Appl. No.: 08/885,984

(22) Filed: Jun. 30, 1997

(51) Int. Cl.[7] ..... H04R 3/00; H04R 9/08

(52) U.S. Cl. ..... 381/92; 381/356; 381/365; 381/122

(58) Field of Search ..... 381/306, 26, 333, 381/91, 92, 95, 122, 355, 356, 358, 361, 365, 366, 368, 375, 388, FOR 125, FOR 165; 361/683, 681

(56) References Cited

U.S. PATENT DOCUMENTS 3,870,820 A * 3/1975 Suzuki et al. ..... 381/365
4,975,966 A * 12/1990 Sapiejewski ..... 381/359
5,216,711 A * 6/1993 Takagi et al. ..... 381/356
5,226,076 A * 7/1993 Baumhauer, Jr. et al. ... 381/356
5,365,595 A * 11/1994 Li ..... 381/91
5,400,408 A * 3/1995 Lundgren et al. ..... 381/91
5,481,616 A * 1/1996 Freadman ..... 381/388
5,613,011 A * 3/1997 Chase et al. ..... 381/355
5,627,901 A * 5/1997 Josephson et al. ..... 381/91
5,638,455 A * 6/1997 Peiker ..... 381/355
5,682,290 A * 10/1997 Markow et al. ..... 361/683
5,701,347 A * 12/1997 Daniels et al. ..... 381/120
5,703,957 A * 12/1997 McAteer ..... 381/92
5,748,757 A * 5/1998 Kubli et al. ..... 381/91
5,761,322 A * 6/1998 Illingworth et al. ..... 381/385
5,768,163 A * 6/1998 Smith, II ..... 364/705.01

OTHER PUBLICATIONS

Clifford, Martin, "Microphones, 2nd Edition," ©1982, pp. 75–75, 86–96, 102–103.
Christiansen, Donald, et al., "Systems and Applications," Electronic Engineers Handbook, Fourth Edition, ©1997, pp. 23.44–23.45.
Harry F. Olson, Ph.D., "Microphones," Acoustical Engineering, D. Van Nostrand Company, Inc., ©1957, pp. 299–303.

* cited by examiner

*Primary Examiner*—Xu Mei

(57) ABSTRACT

Custom designed polar patterns for a microphone of a portable computer are achieved. A custom designed polar pattern permits a microphone in a portable computer to suppress sources of spatially-dependent noise internal and external to a portable computer system. A custom designed polar pattern is generated by specially configuring the boot of a microphone by varying the hole sizes of the boot and/or varying location of the microphone element in the boot. In addition, the shape of a particular polar pattern may be adjusted by inserting acoustic absorption material into the boot, forming enclosed walls into the boot, or rotating the top shell of the portable computer which contains the microphone relative to the bottom shell of the portable computer. Thus, a directional response of a microphone may be form-fitted to a particular portable computer configuration.

47 Claims, 3 Drawing Sheets

METHOD OF CUSTOM DESIGNING DIRECTIONAL RESPONSES FOR A MICROPHONE OF A PORTABLE COMPUTER

CROSS REFERENCE TO RELATED APPLICATIONS

This application is related to commonly owned and copending application Ser. No. 08/885,490, filed on Sep. 30, 1997, entitled "A MICROPHONE OF THE CARDIOID FAMILY FOR STANDALONE PORTABLE USE AND EXPANSION BASE USE" incorporated by reference herein.

BACKGROUND OF THE INVENTION

1. Field of the Invention

The present invention relates to portable computer systems having associated microphones.

2. Description of the Related Art

Portable computers are increasingly integrating multimedia functionality present in desktop computers to achieve an enhanced multimedia environment. Such multimedia functionality has predominantly been on the playback side of portable sound technology, encompassing sound devices such as CD-ROM drives, sound boards, and speakers in order to improve sound quality for portable computer users. While playback side enhancements in portable sound technology have been suited to home or office use, recording side features in portable sound technology are particularly suited to an office environment wherein voice communication applications such as audio conferencing, teleconferencing and telephony have been frequently utilized, and wherein voice recognition applications will likely become more prevalent.

On the recording side of portable sound technology, speakerphone functionality has been integrated into portable computers allowing for a portable computer with a speakerphone mode. In a full duplex, speakerphone mode, both the speaker and the microphone are on so that listening and talking may be simultaneous for a portable computer user. In addition, the speaker and microphone are acoustically coupled such that sound waves from the microphone travel to the speaker. In order to prevent acoustic feedback due to sound waves traveling from the microphone to the speaker, acoustic coupling may be reduced between the speaker and the microphone by suppressing sound waves from certain directions. This reduction in acoustic coupling is termed acoustic coupling loss.

Microphones predominantly used in portable computers are omni-directional microphones, cardioid microphones, or supercardioid microphones. An omni-directional microphone is a microphone with an even or equal response sensitivity to sound from all directions over a full 360° range. As such, the direction response pattern for an omni-directional microphone as a function of location with respect to it is a uniform level, graphically full circle. A cardioid microphone is a microphone having a heart-shaped direction response pattern resembling a graph of a mathematical cardioid function originally developed by Pascal. A cardioid microphone is improved over an omni-directional microphone in that a cardioid microphone has maximum sensitivity in the forward direction and reduced sensitivity to sounds arriving from a side or rear direction with respect to the longitudinal axis of the microphone. A supercardioid microphone has a direction response pattern more attenuated for sounds arriving from a side direction than a cardioid direction response pattern. Also, while a cardioid direction response pattern includes a single heart-shaped lobe or bulb, a supercardioid direction response pattern includes a heart-shaped front lobe for areas forward of the microphone along its longitudinal axis and an oval-shaped back or rear lobe.

Microphones in portable computers have been selected based on the general directivity associated with the microphone. That is, when marginal or minimal acoustic performance of a microphone in a portable computer is desired, omni-directional microphones have typically been chosen. When improved acoustic performance of a microphone in a portable computer is desired, cardioid or supercardioid microphones have typically been chosen. In comparison to omni-directional microphones, cardioid and supercardioid microphones produce generally improved cancellation of noise sources located external to a portable computer system. A cardioid or supercardioid microphone, however, may not be particularly suited to the spatially dependent noise sources internal to a portable computer, nor to the specific acoustic environment of a portable computer.

SUMMARY OF THE INVENTION

Briefly, according to the present invention, custom designed polar patterns for a microphone of a portable computer are achieved. It has been found that custom designing a polar pattern for a microphone of a portable computer adequately accounts for the varying locations of noise sources internal to a portable computer system and the varying acoustic environments for different designs of a portable computer system. The custom designed polar patterns are achieved by specially configuring the boot, which houses the microphone element of the portable computer microphone between the front and back portable housing surfaces. The desired polar pattern is achieved by specially configuring the hole sizes of the boot for passage of acoustic energy, and/or varying the distances between the microphone element and the front and back portable housing surfaces. Further, adding acoustic absorption material inside the boot such as foam or forming enclosed walls into the boot may be used in adjusting the shape of a particular polar pattern. Adjusting the position of the top shell of the portable computer relative to the bottom shell allows even further refinement of the polar pattern. Thus, the boot of a microphone may be specially configured for each portable computer design or configuration to achieve a directional response form-fitted to the particular portable computer configuration.

BRIEF DESCRIPTION OF THE DRAWINGS

A better understanding of the present invention can be obtained when the following detailed description of the preferred embodiment is considered in conjunction with the following drawings, in which.

DESCRIPTION OF THE PREFERRED EMBODIMENT

Figure 1:
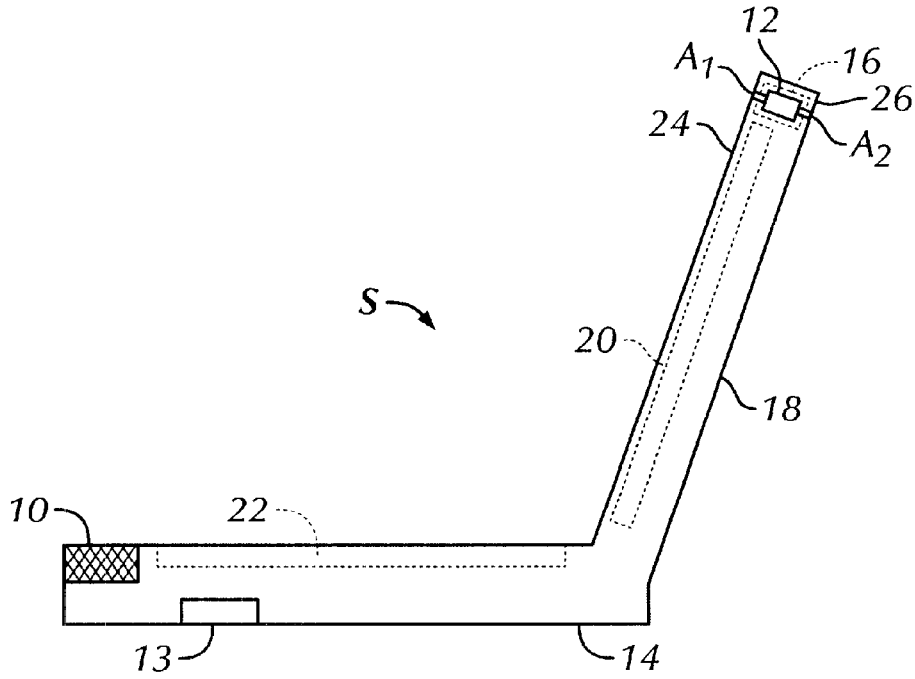
FIG. 1 is a side elevation view of a portable computer system of the present invention.

Turning now to the drawings, FIG. 1 shows a side view of a portable computer system S of the present invention. The portable computer S includes dual speakers 10 and a microphone 12 to allow for speakerphone functionality. The speakers 10 of the present invention portable computer S are preferably located in the top surface of the bottom shell 14 of the portable computer S at a location near the portable computer user. It should be understood that the speakers 10 may be placed in other locations that would allow for suitable listening by a portable computer user. The microphone 12 is housed in a microphone case 16 shown in broken or dashed line. The microphone 12 is activated by a processor 13 of the portable computer S which is usually located in the bottom shell 14. The microphone case 16 is placed in a suitable location for detecting voice signals from the portable computer user. These signals are processed by the processor in the usual manner. It should be understood that additional microphones may be placed in other locations in the portable computer S if necessary to achieve the desired polar response. The microphone case 16 is preferably located in the top shell 18 of the portable computer S at a location above a conventional display screen shown schematically at 20. At such a position, the microphone 12 within the microphone case 16 suitably detects voice signals from a portable computer user positioned behind the keyboard 22 of the portable computer S and facing the display screen 20. It should be understood that the microphone case 16 may be located in any position that would allow for suitable detection of the user's voice. The microphone case 16 as well as the portable computer housing surfaces 24 and 26 adjacent to the microphone case 16 include holes or passages $A_1$ and $A_2$ which allow for passage of sound waves into the microphone case 16.

Figure 2:
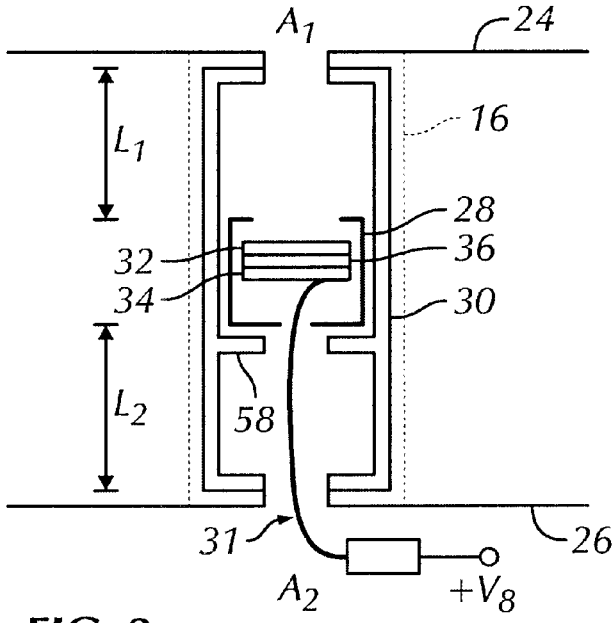
FIG. 2 is an enlarged cross-sectional view of portable housing surfaces of the computer system of FIG. 1 showing the microphone having a hypercardioid polar pattern generated according to the present invention.

Referring to FIG. 2, the components within the microphone case 16 of FIG. 1 are shown in a somewhat enlarged size. The microphone case components include a microphone element 28 and a boot or housing 30. The boot 30 is preferably made of rubber or other suitable acoustic energy dissipating or sound isolating material which holds or mounts the microphone element 28 in place. The microphone element 28 is preferably a self-polarized or electric capacitor element. It should be understood that other microphone elements may be placed within the boot 30 if necessary to achieve a desired polar response.

The microphone 12 is a pressure-gradient microphone due to the implementation of both front and back holes or apertures $A_1$ and $A_2$ formed in the microphone case 16 and boot 30. The presence of rear opening $A_2$ causes the diaphragm 32 to detect and respond to pressure differentials rather than absolute pressure levels. The response of the microphone 12 therefore is direction sensitive. That is, the direction of a sound wave affects the degree to which the wave energy is suppressed by the microphone 12.

Figure 3:
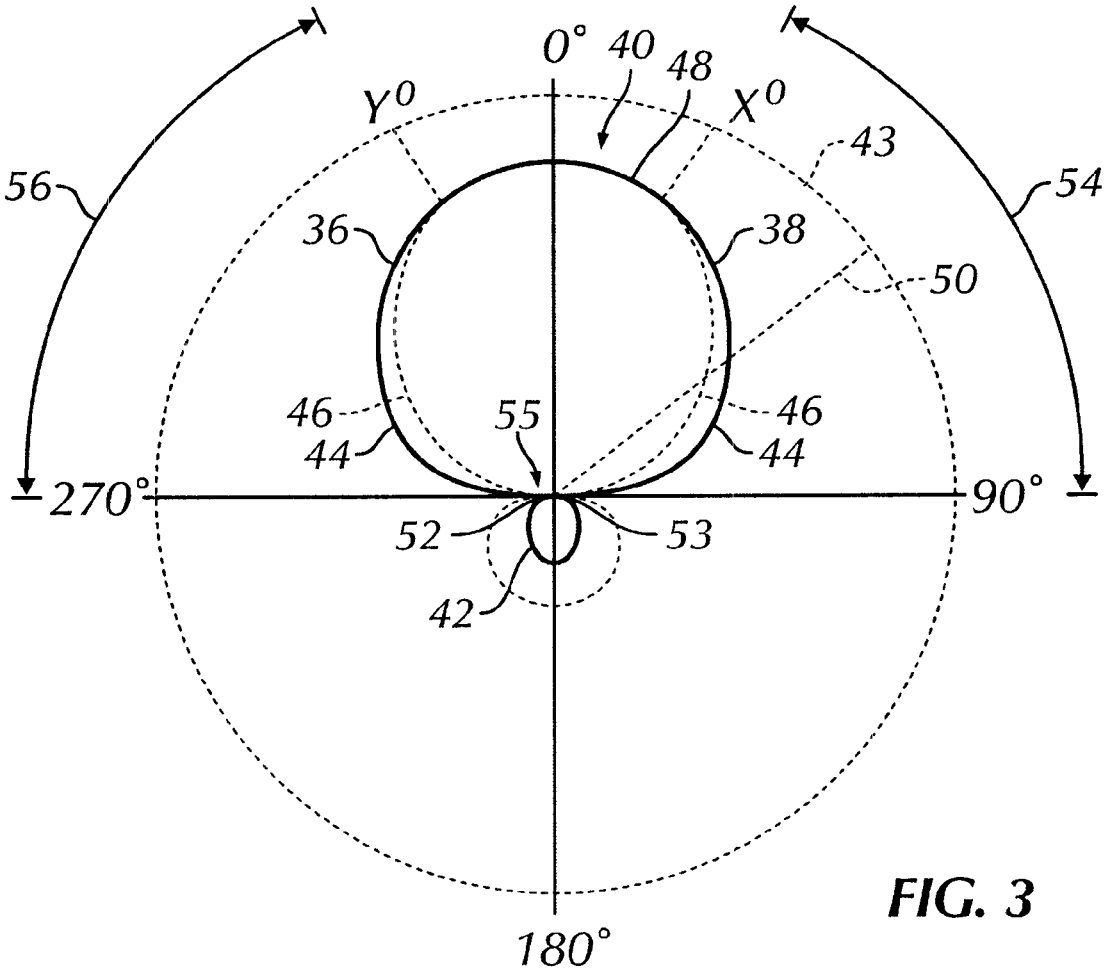
FIG. 3 is a polar diagram showing a hypercardioid polar pattern generated according to the present invention and a supercardioid pattern according to the present invention.

Performance of microphones is measured and charted in directivity or polar patterns of the type shown in FIG. 3 of the drawings. FIG. 3 is a polar diagram which represents the sensitivity of a microphone to the directionality of sound. Polar diagrams of this type are produced by taking responsivity measures or sampling voltage measurements in equal degree increments, as a function of radial locations about a 360° circle with respect to the microphone of interest. This is done by moving a microphone under examination in free space around a sound source so as to integrate measurements for the full 360 degrees of radial positions. The sound source may be traversed by the microphone horizontally, vertically, or angularly. The 0° axis or on axis represents the front of the microphone facing the sound source, and the 180° axis represents the rear of the microphone facing the sound source.

A polar or directivity pattern thus represents the directional response of a microphone and is illustrated using a polar diagram. Each polar pattern has a directivity factor or measure represented as Q. The Q of a polar pattern is calculated as a summation of relative pressure values for the particular polar pattern, typically at the 0° axis, divided by the relative pressure measurements for an omni-directional pattern, which serves as a normalization value. The directivity factor Q for an omni-directional polar pattern is 1, and the directivity factor Q for a supercardioid polar pattern 36 is typically about 3. Thus, the supercardioid polar pattern 36 can be seen to have a high directivity factor. Proximity to the outer circle 43 of a polar diagram represents low directional efficiency, and proximity to the center 52 of a polar diagram represents high directional efficiency. Therefore, it can be seen that the supercardioid polar pattern 36 has a high directional efficiency as well as a high directivity factor.

As further illustration, the supercardioid polar pattern 36 includes null regions at 53 and 55 defined by the intersection of the supercardioid pattern 36 with the horizontal axis of the polar diagram. These null regions or locations on the 90° axis and the 270° axis represent maximum suppression of sound waves generated directly from the sides of a supercardioid microphone. In addition, the supercardioid polar pattern 36 includes a heart-shaped front lobe 40 illustrated in the top half of the polar diagram and an oval-shaped rear lobe 42 illustrated in the bottom half of the polar diagram.

Although a supercardioid microphone has greater directional efficiency than an omni-directional microphone, it can be seen from FIG. 3 that a supercardioid microphone fails to suitably reject noise from sound sources located at off-angle radial positions (for example angles between 30° and 60° and between 300° and 330°) in front of the supercardioid microphone. Off angle radial positions such as these in front of the microphone are those angles within the 180° range toward the front of a microphone that are not needed to suitably detect the voice of a portable user positioned in front of the microphone.

Figure 5:
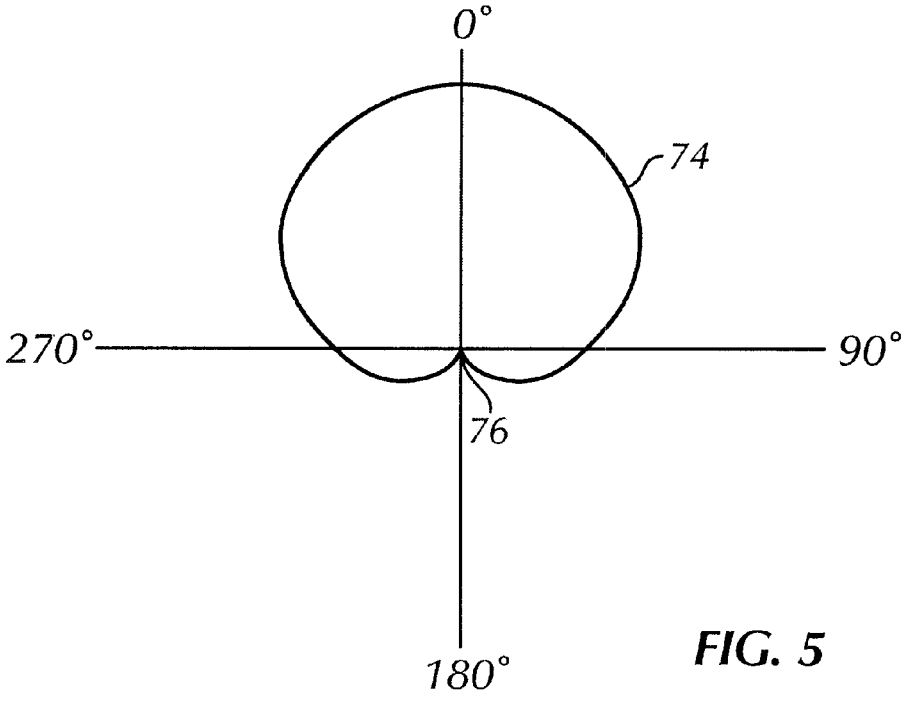
FIG. 5 is a polar diagram showing a cardioid polar pattern generated according to the present invention.

Referring to FIG. 5, a cardioid polar pattern response 74 is shown. Cardioid and supercardioid microphones having a generally improved directional pattern in comparison to an omni-directional microphone were considered to have adequate directionality for voice applications using a portable computer. Yet, conventional portable computers having cardioid and supercardioid microphones have allowed certain noise sources internal and external to the computer system to impair the acoustic performance of microphones.

With the present invention, it has been found that improved directional performance can be achieved for a particular portable computer system by specially configuring the boot 30. Portable computer designs typically have different locations for noise sources internal to a portable computer system. If the noise locations internal to a portable computer are not considered, such noise sources may impair the acoustic performance of a microphone in a portable computer, thus leading to recognition errors in voice recognition applications and to degraded voice quality in telephony applications. The present invention, by custom designing a polar pattern for a microphone of a particular design of a portable computer system, accounts for the noise source locations particular to the portable computer system and its environment. It thus provides suitable direction response for voice applications and attenuates the microphone's sensitivity to such noise sources.

A microphone according to the present invention may be custom designed to achieve polar patterns corresponding to a direction characteristic such as hypercardioid pattern, supercardioid pattern, cardioid pattern, bipolar pattern, a pseudo version of these types, or other types of polar patterns (also known as limacon curves). As can be seen in FIG. 3, a hypercardioid microphone is similar to a supercardioid microphone, in that its direction response pattern 38 also has two lobes; however, the hypercardioid microphone is more attenuated for sounds arriving from the side than a supercardioid microphone. Additionally, the hypercardioid is more sensitive to sounds arriving from the rear of the longitudinal axis of the microphone than a supercardioid. Further, in contrast to cardioid, supercardioid, and hypercardioid microphones, a bipolar microphone has a directional response pattern 64 depicted in FIG. 4 which is equally sensitive to sound from a forward direction and a rearward direction. A polar pattern of a bipolar microphone includes a lobe 60 in an area forward of the microphone with respect to its longitudinal axis and an equally sized lobe 62 in an area behind the microphone with respect to its longitudinal axis.

The boot for a microphone custom designed according to the present invention, is configured by adjusting the sizes of holes $A_1$ and $A_2$ or by varying the lengths of path lines $L_1$ and $L_2$ which correspond to the distances between the microphone element and the front and rear surfaces 24 and 26 (FIG. 2) of the portable computer case 16. Also, adding acoustic absorption material in the boot 30 such as foam or forming enclosed walls into the boot may be used to adjust the shape of a particular polar pattern. In custom designing a particular cardioid polar pattern, the rear hole size $A_2$ is sufficiently open such that the pressure in front of the microphone element and the pressure in the rear of the microphone element are essentially equal. In custom designing a particular supercardioid polar pattern, the rear hole size $A_2$ is relatively closed with respect to front hole size $A_1$. Also, path line lengths $L_1$ and $L_2$ may be configured such that a microphone element 28 is located relatively close to the front portable surface 24. So far as is known, path line lengths $L_1$ and $L_2$ for a microphone boot in portable computers have strictly been defined for mechanical reasons as opposed to acoustic reasons.

In custom designing a particular hypercardioid polar pattern, the rear hole size $A_2$ is substantially equal to the front hole size $A_1$. Also, path lines $L_1$ and $L_2$ may be configured such that path line length $L_1$ is close to or greater than the length of path line $L_2$. In addition, the null locations of a hypercardioid polar pattern 38 are a function of the path line lengths $L_1$ and $L_2$. The thin or narrow side directivity performance lobes or bulbs associated with a bipolar or bidirectional polar pattern 64 are superimposed or integrated with the characteristics of the conventional supercardioid pattern 36 to produce a hypercardioid polar pattern 38 in a portable computer (FIG. 3). In custom designing a particular bipolar pattern 64, the holes $A_1$ and $A_2$ are substantially equal and are largely sized relative to the length of path lines $L_1$ and $L_2$ such that the microphone element has a high direction sensitivity to pressure differentials. Further, a plurality of microphones may be placed in the housing of a computer S and acoustically coupled in such a way as to generate an overall response pattern having the desired directional characteristics. Also, a plurality of microphone elements 28 may be employed in the boot 30 and acoustically coupled in such a way as to generate an overall response pattern having the desired directional characteristics.

Figure 4:
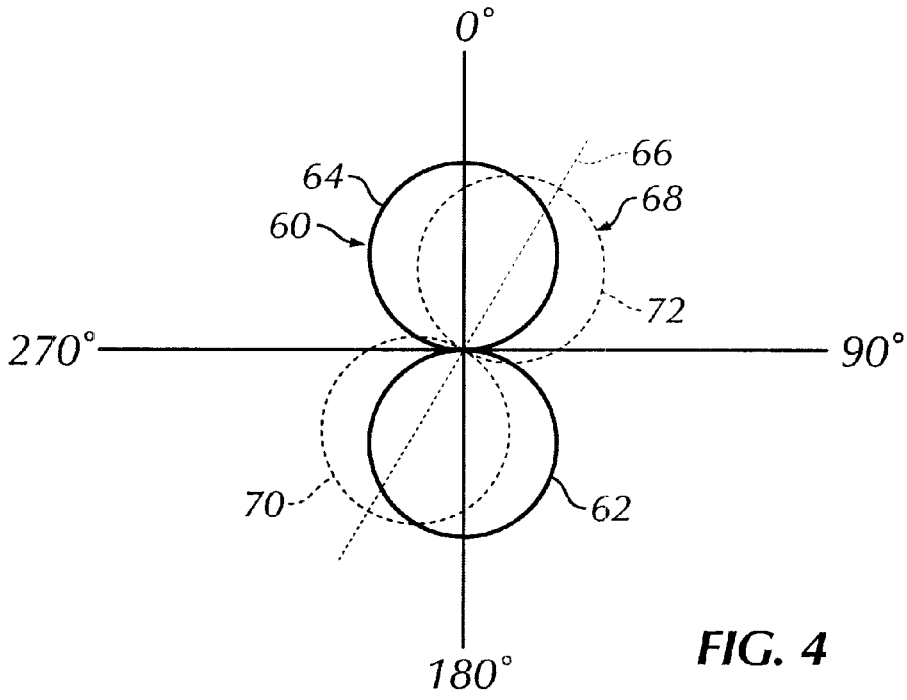
FIG. 4 is a polar diagram showing a bipolar polar pattern generated according to the present invention.

Additionally, adjusting the position of the top shell 18 of the portable computer case depicted in FIG. 1, which houses the microphone case 16, relative to the bottom shell 14 of the portable computer case allows for rotation of the polar pattern. For example, FIG. 4 depicts a bipolar response pattern 68 which has been re-oriented to lie along a new axis 66 from its original orientation 64, due to an adjustment to the angle between the top shell 18 and the bottom shell 14. By rotating a polar pattern, the directional response of a microphone is adjusted to place a noise source of interest in the null regions associated with the polar pattern.

The front-to-back hole size ratio $A_1/A_2$, the lengths of the path lines $L_1$ and $L_2$, the acoustic absorption materials inside the boot 30, and/or the plurality of enclosed walls in the boot 30 serving as acoustic masses may vary with different configurations of a portable computer S. Likewise, the hole size ratio, the path line lengths $L_1$ and $L_2$, the internal acoustic absorption materials, the enclosed walls of boot 30, and/or the position of the top shell 18 relative to the bottom shell 14 necessary to achieve the desired polar pattern 38 with the highest or sufficiently high directivity factor Q, which pattern may be termed a form-fitted polar pattern, may vary with each portable computer configuration. In some instances, adjusting the hole size ratio $A_1/A_2$ may be used to obtain a desired directional characteristic in accordance with the present invention, and then the path line lengths $L_1$ and $L_2$, internal acoustic absorption materials, enclosed walls formed into the boot 30, and/or the position of the top shell 18 may be adjusted or implemented to generate a form-fitted microphone response. In other instances, in accordance with the present invention, adjusting the path line lengths $L_1$ and $L_2$ may be used to obtain a desired directional characteristic and then the hole size ratio $A_1/A_2$, internal acoustic absorption materials, enclosed walls formed into the boot 30, and/or the position of the top shell 18 may be adjusted or implemented to generate a form-fitted microphone response.

Thus, the present invention not only achieves a directivity pattern 38 from a microphone 12 in a portable computer S, but also achieves a form-fitted directivity pattern for various portable computer configurations. It should be understood that the specially configured boot of the present invention extends to systems other than portable computers which are capable of embedding or including a boot containing a microphone element. Also, it should be understood that there may be mechanical system parameters which affect the choice of hole size ratio $A_1/A_2$ and choice of path line lengths $L_1$ and $L_2$ in generating the desired polar pattern.

For a portable computer, noise external to the computer system typically originates from areas at off angle radial positions in front of the area where a portable computer user is located. The wide circular sides 44 of the front lobe 40 of the supercardioid polar pattern 36 correspond to these noise sources such that the sides 44 represent directional inefficiency. Thus, due to its polar pattern, a supercardioid microphone generally lacks adequate directionality for voice applications in certain portable computers.

The portable computer microphone 36 (FIG. 2) configured according to the present invention to generate a hypercardioid microphone response has been found to provide adequate directionality for voice applications in certain portable computers. For example, as illustrated by the polar diagram in FIG. 3, a hypercardioid polar or directivity pattern 38 of microphone 12 achieves greater directional efficiency with respect to sound sources located at off angle radial positions in front of the microphone 12. This improved directional efficiency corresponds to the thinner circular sides at 46 of a front lobe 48 of the hypercardioid polar pattern 38. For example, a ray 50 shown in broken or dashed line is shown schematically to intersect both the supercardioid directivity pattern 36 and the hypercardioid directivity pattern 38 of the present invention at a position associated with a sound source at an off angle radial position in front of the microphone. It can be seen that the hypercardioid pattern 38 lies closer to the center 52 of the polar diagram than the supercardioid pattern 36. As such, the hypercardioid pattern 38 has greater directional efficiency and cancellation with respect to background noise from sound sources located at off angle radial positions in front of the microphone as compared to the supercardioid pattern 36.

In addition to the exemplary ray 50 illustrated in FIG. 3, the hypercardioid pattern 38 also lies closer to the center 52 of the polar diagram than the supercardioid pattern 36 for a degree range 54 defined between X° and 90° and a degree range 56 defined between Y° and 270° corresponding to sound fields located at off angle radial positions in front of the microphone 12. Therefore, a hypercardioid pattern 38 associated with the microphone direction response of the present invention is directionally efficient for such ranges of off angle radial positions in front of the microphone 12. Further, the hypercardioid polar pattern 38 has a directivity factor typically between 5 and 6 which demonstrates that a hypercardioid pattern is generally more directionally efficient than a supercardioid pattern 36. However, it will sometimes be advantageous to utilize other polar patterns to place noise sources, both internal and external to a portable computer S, within the areas of low or zero sensitivity, such as points 53 and 55 shown in FIG. 3.

Thus, according to the present invention, custom designed polar patterns for a microphone of a portable computer are achieved. A desired polar pattern may be achieved by specially configuring the hole sizes of the boot and/or varying the location of the microphone element within the boot. The shape of the polar pattern may then be adjusted for a particular portable compute configuration by adding acoustic absorption material within the boot, forming enclosed walls into the boot, or adjusting the position of the top shell of the portable computer relative to the bottom shell.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

We claim:

1. A method for achieving a directional response associated with a desired polar pattern of a microphone in a portable computer having a top shell and bottom shell, comprising the steps of:

placing a microphone element in a boot, said boot secured between front and rear surfaces of the top shell, and configuring said boot to cause the microphone to exhibit a directional response associated with a desired polar pattern to compensate for noise sources internal to the portable computer, comprising the step of:

varying a hole size ratio between the front hole and the rear hole to achieve the desired polar response pattern.

2. The method of claim 1, said boot having a front hole and a rear hole, wherein said configuring step comprises the step of varying hole size ratio between the front hole and the rear hole to achieve the desired polar pattern response.

3. The method of claim 1, wherein said configuring step comprises the step of inserting acoustic absorption material inside said boot to achieve the desired polar pattern response.

4. The method of claim 1, wherein said configuring step comprises the step of forming enclosed walls into the boot to achieve the desired polar pattern response.

5. The method of claim 1, wherein said configuring step comprises the step of adjusting the angle between said top shell and said bottom shell to achieve the desired polar pattern response.

6. The method of claim 1, wherein said desired polar pattern is form-fitted to a particular configuration of said portable computer.

7. The method of claim 1, wherein said desired polar pattern is a cardioid pattern.

8. The method of claim 1, wherein said desired polar pattern is a supercardioid pattern.

9. The method of claim 1, wherein said desired polar pattern is a hypercardioid pattern.

10. The method of claim 1, wherein said desired polar pattern is a pseudo-hypercardioid pattern.

11. The method of claim 1, wherein said desired polar pattern is a bipolar pattern.

12. A portable computer having a microphone for receiving acoustic signals and generating a directional response associated with a desired polar pattern, comprising:

a processor for activating said microphone and processing electrical signals corresponding to acoustic signals received by said microphone;

a container, comprising:

a bottom shell housing said processor; and a top shell having a front-surface and a rear surface, connected to said bottom shell;

a microphone located between said front and rear top shell surfaces, said microphone comprising:

a microphone element for receiving acoustic signals; and a boot for mounting and isolating said microphone element, said boot configured to achieve a desired microphone directional response associated with a particular polar pattern to compensate for noise sources internal to the portable computer, wherein the position of said microphone element defines a front distance and a rear distance, the front distance being the distance between said microphone element and said front shell surface, and the rear distance being the distance between said microphone element and said rear shell surface, and wherein said front distance and said rear distance are varied to achieve a desired microphone directional response associated with a particular polar pattern.

13. The portable computer of claim 12, wherein said boot has a front hole and a rear hole, said front hole and rear hole sized to achieve a desired microphone directional response associated with a particular polar pattern.

14. The portable computer of claim 13, wherein said rear hole size is large compared to the front hole to achieve a cardioid polar pattern response.

15. The portable computer of claim 13, wherein said rear hole size is smaller than said front hole size to achieve a supercardioid polar pattern response.

16. The portable computer of claim 13, wherein said rear hole size is substantially equal to said front hole size to achieve a hypercardioid polar pattern response.

17. The portable computer of claim 16, the location of said microphone element in said boot defining path line lengths of said boot, wherein said front hole size and said rear hole sizes are large compared to the path line lengths of said boot to achieve a bipolar polar pattern response.

18. The portable computer of claim 12, wherein said front distance is substantially less than said rear distance to achieve a supercardioid polar pattern.

19. The portable computer of claim 12, wherein said front distance is substantially equal to said rear distance to achieve a hypercardioid polar pattern.

20. The portable computer of claim 12, wherein said front distance is substantially greater than said rear distance to achieve a hypercardioid polar pattern.

21. The portable computer of claim 12, wherein said boot is configured to adjust a particular polar pattern to achieve a form-fitted directional microphone response.

22. The portable computer of claim 21, wherein said adjustment is achieved by inserting acoustic absorption materials into said boot.

23. The portable computer of claim 21, wherein said adjustment is achieved by forming enclosed walls into said boot.

24. A portable computer having a microphone for receiving acoustic signals and generating a directional response associated with a desired polar pattern, comprising:

a processor for activating said microphone and processing electrical signals corresponding to acoustic signals received by said microphone;

a container, comprising:

a bottom shell housing said processor; and a top shell having a front surface and a rear surface, connected to said bottom shell;

a microphone located between said front and rear top shell surfaces, said microphone comprising:

a microphone element for receiving acoustic signals; and a boot for mounting and isolating said microphone element, said boot configured to achieve a desired microphone directional response associated with a particular polar pattern to compensate for noise sources internal to the portable computer, wherein said boot is configured to adjust a particular polar pattern to achieve a form-fitted directional microphone response, wherein the position of said microphone element defines a front distance and a rear distance, the front distance being the distance between said microphone element and said front shell surface, the rear distance being the distance between said microphone element and said rear shell surface, and wherein said adjustment is achieved by varying the front distance and said rear distance to set the null regions of said particular polar pattern.

25. The portable computer of claim 12, wherein said particular polar pattern is a hypercardioid pattern.

26. The portable computer of claim 12, wherein said particular polar pattern is a cardioid pattern.

27. The portable computer of claim 12, wherein said particular polar pattern is a supercardioid pattern.

28. The portable computer of claim 12, wherein said particular polar pattern is a bipolar pattern.

29. The portable computer of claim 12, wherein said particular polar pattern is a pseudo-hypercardioid pattern.

30. A portable computer microphone for receiving acoustic signals and generating a directional response associated with a desired polar pattern, comprising:

a microphone element for receiving acoustic signals; and a boot for mounting and isolating said microphone element, said boot configured to achieve a desired microphone directional response associated with a particular polar pattern to compensate for noise sources internal to a portable computer, wherein the position of said microphone element defines a front distance and a rear distance, the front distance being the distance between said microphone element and a front hole in said boot, the rear distance being the distance between said microphone element and a rear hole in said boot, and wherein said front distance and said rear distance are varied to achieve a desired microphone directional response associated with a particular polar pattern.

31. The portable computer microphone of claim 30, said boot having a front hole and a rear hole, wherein said front hole and rear hole are sized to achieve a desired microphone directional response associated with a particular polar pattern.

32. The portable computer microphone of claim 30, wherein said rear hole size is large compared to the front hole to achieve a cardioid polar pattern response.

33. The portable computer microphone of claim 30, wherein said rear hole size is small compared to said front hole size to achieve a supercardioid polar pattern response.

34. The portable computer microphone of claim 30, wherein said rear hole size is substantially equal to said front hole size to achieve a hypercardioid polar pattern response.

35. The portable computer microphone of claim 34, the location of said microphone element in said boot defining path line lengths of said boot, wherein said front hole size and said rear hole size is large compared to the path line lengths of said boot to achieve a bipolar polar pattern response.

36. The portable computer microphone of claim 30, wherein said front distance is substantially less than said rear distance to achieve a supercardioid polar pattern.

37. The portable computer microphone of claim 30, wherein said front distance is substantially equal to said rear distance to achieve a hypercardioid polar pattern.

38. The portable computer microphone of claim 30, wherein said front distance is substantially greater than said rear distance to achieve a hypercardioid polar pattern.

39. The portable computer microphone of claim 30, wherein said boot is configured to adjust a particular polar pattern to achieve a form-fitted directional microphone response.

40. The portable computer microphone of claim 39, wherein said adjustment is achieved by inserting acoustic absorption materials into said boot.

41. The portable computer microphone of claim 39, wherein said adjustment is achieved by forming enclosed walls into said boot.

42. The portable computer microphone of claim 39, wherein said adjustment is achieved by varying said front distance and said rear distance to set the null regions of said particular polar pattern.

43. The portable computer microphone of claim 30, wherein said particular polar pattern is a hypercardioid pattern.

44. The portable computer microphone of claim 30, wherein said particular polar pattern is a cardioid pattern.

45. The portable computer microphone of claim 30, wherein said particular polar pattern is a supercardioid pattern.

46. The portable computer microphone of claim 30, wherein said particular polar pattern is a bipolar pattern.

47. The portable computer microphone of claim 30, wherein said particular polar pattern is a pseudo-hypercardioid pattern.

* * * * *